US006655350B2

(12) United States Patent
Kamoto

(10) Patent No.: US 6,655,350 B2
(45) Date of Patent: Dec. 2, 2003

(54) IDLE SPEED CONTROL SYSTEM AND CONTROL METHOD FOR INTERNAL COMBUSTION ENGINE

(75) Inventor: Akira Kamoto, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/909,907

(22) Filed: Jul. 23, 2001

(65) Prior Publication Data

US 2002/0011235 A1 Jan. 31, 2002

(30) Foreign Application Priority Data

Jul. 28, 2000 (JP) ..... 2000-229656

(51) Int. Cl.[7] ..... F20D 41/00
(52) U.S. Cl. ..... 123/339.22; 123/339.19
(58) Field of Search ..... 123/339.19, 339.1, 123/339.22

(56) References Cited

U.S. PATENT DOCUMENTS 6,009,852 A * 1/2000 Akabori et al. ..... 123/197.4
6,039,028 A * 3/2000 Stuntz et al. ..... 123/436
6,085,723 A * 7/2000 Pels et al. ..... 123/339.22
6,109,236 A * 8/2000 Takahashi et al. ..... 123/339.19
6,109,238 A * 8/2000 Sakai ..... 123/339.22
6,415,766 B1 * 7/2002 Kanno et al. ..... 123/339.19

FOREIGN PATENT DOCUMENTS

| | | |
|---|---|---|
| DE | 690 23 236 | 3/1996 |
| JP | 59-145339 | 8/1984 |
| JP | 05-222997 A | 8/1993 |
| JP | 06-137246 A | 5/1994 |
| JP | 11-343915 A | 12/1999 |
| JP | 2000-291467 | 10/2000 |
| JP | 2000-320379 | 11/2000 |
| JP | 2000-345897 | 12/2000 |
| JP | 2000-352339 | 12/2000 |

* cited by examiner

*Primary Examiner*—John Kwon
(74) *Attorney, Agent, or Firm*—Oblon, Spivak, McClelland, Maier & Neustadt, P.C.

(57) ABSTRACT

An idle speed control system of an internal combustion engine controls a speed of the internal combustion engine during idling. In its attempt to shift the idle speed control after the internal combustion engine has been started from an open-loop control to a feedback control, the system brings an actual engine speed in the open-loop control to a target speed of the feedback control in a step-by-step manner. It can thus damp shock that occurs when the open-loop control is shifted to the feedback control after the internal combustion engine has been started.

17 Claims, 5 Drawing Sheets

IDLE SPEED CONTROL SYSTEM AND CONTROL METHOD FOR INTERNAL COMBUSTION ENGINE

INCORPORATION BY REFERENCE

The disclosure of Japanese Patent Application No. 2000-229656 filed on Jul. 28, 2000 including the specification, drawings and abstract is incorporated herein by reference in its entirety.

BACKGROUND OF THE INVENTION

1. Field of the Invention

The invention relates to an internal combustion engine speed control system and control method for controlling an idle speed of an internal combustion engine.

2. Description of the Related Art

When an idle speed of an internal combustion engine becomes unstable, it may result in the engine stalling or induce unpleasant engine vibration. The amount of intake air during idling may also be affected by changes occurring over time in the respective parts of the internal combustion engine (for example, deposits to areas around a throttle valve change the amount of intake air and friction), causing the idle speed which has so far been stable to become unstable. To stabilize idle speed of internal combustion engines, idle speed control disclosed in, for example, Japanese Patent Application Laid-Open Publication No. HEI 6-137246, is provided.

In the idle speed control disclosed in the above publication, the engine speed goes through two different phases of control, namely, an open-loop control (with a fixed control value) provided for a period immediately after the engine has been started, which is followed by a feedback control. In such a control method, however, variations in specifications among different internal combustion engines produce differences in the idle speed during the open-loop control, making one idle speed too low and another too high. For example, if the control proceeds to the feedback phase when the idle speed is low, the idle speed is increased by a large margin, which is felt as a shock by the driver. This has been a problem to be solved.

SUMMARY OF THE INVENTION

It is therefore an object of the invention to provide an idle speed control system for an internal combustion engine that can damp shock occurring when an open-loop control is switched to a feedback control after the internal combustion engine has been started.

To achieve the foregoing object, an idle speed control system for an internal combustion engine according to a first aspect of this invention brings an engine speed, in its attempt to shift the idle speed control after the internal combustion engine has been started from an open-loop control to a feedback control, to a target speed of the feedback control in a step-by-step manner.

An idle speed control system for an internal combustion engine according to a second aspect of the invention maintains, in its attempt to shift the idle speed control after the internal combustion engine has been started from an open-loop control to a feedback control, an engine speed during the open-loop control for a predetermined period of time and, when the difference from a target speed of the feedback control becomes less than a predetermined value, shifts to the feedback control using the target speed.

An idle speed control system for an internal combustion engine according to a third aspect of the invention sets, in its attempt to shift the idle speed control after the internal combustion engine has been started from an open-loop control to a feedback control, a secondary target speed that falls within a range from an engine speed of the open-loop control to a main target speed of the feedback control and performs a control for bringing the idle speed to the secondary target speed before shifting to the feedback control using the main target speed.

An idle speed control system for an internal combustion engine according to a fourth aspect of the invention controls the idle speed according to a coolant temperature of the internal combustion engine and, when the coolant temperature becomes greater than or equal to a predetermined value, shifts the idle speed control from an open-loop control to a feedback control. If the difference between the engine speed when the coolant temperature becomes the predetermined value and a target speed of the feedback control is greater than or equal to a predetermined value, the system maintains the idle speed for a predetermined period of time before shifting to the feedback control using the target speed.

DETAILED DESCRIPTION OF THE PREFERRED EMBODIMENTS

Figure 1:
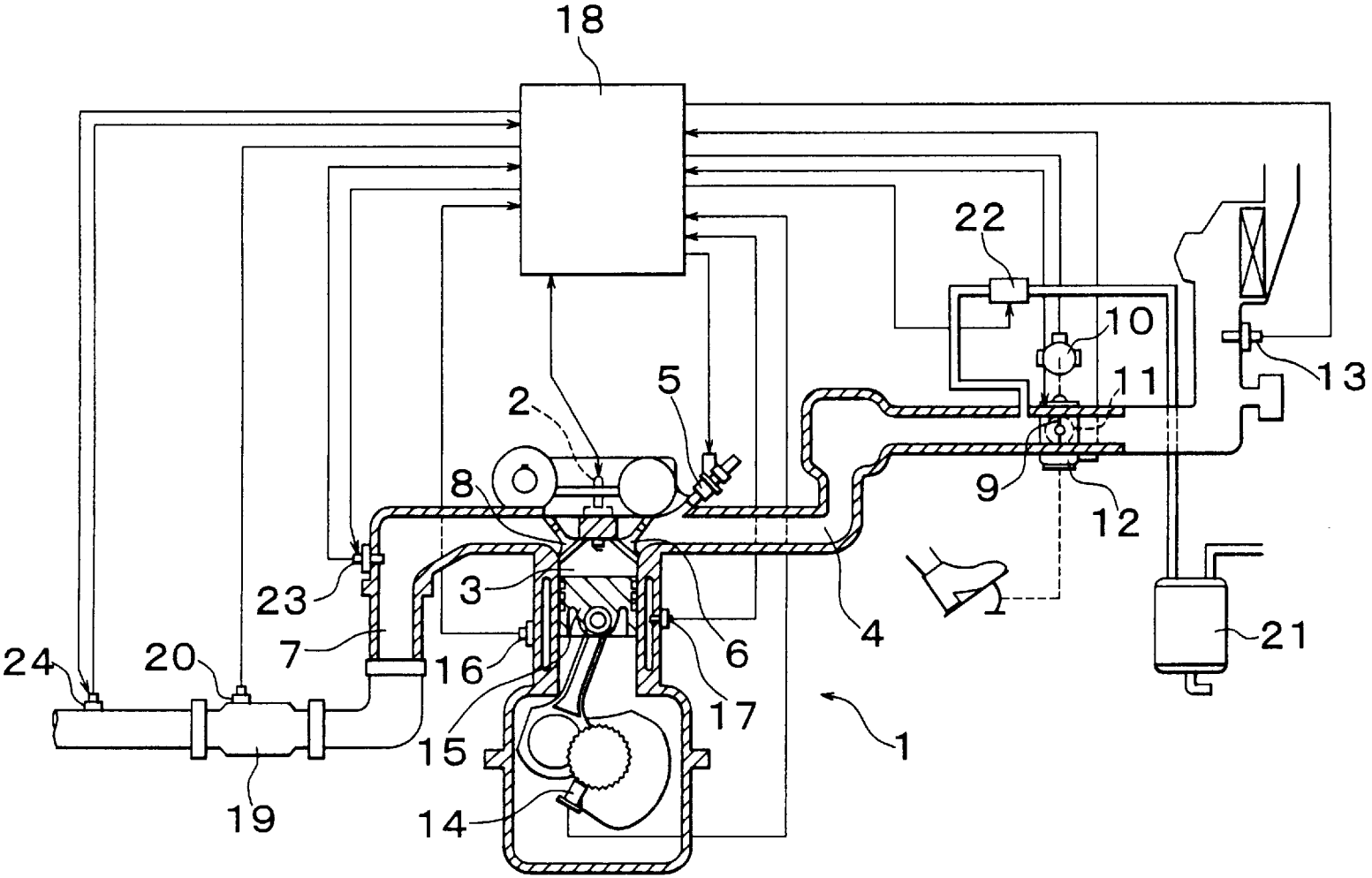
FIG. 1 is a sectional view showing an internal combustion engine having one embodiment of a control system according to the invention.

A control system according to one embodiment of the invention controls an idle speed of an engine 1 which is an internal combustion engine. Though the engine 1 is a multi-cylinder engine, the sectional view shows only one of the cylinders. Referring to FIG. 1, the engine 1 generates a driving force using an ignition plug 2 that ignites a mixture in a cylinder 3. For combustion in the engine 1, air drawn from an outside passes through an intake passage 4 and is mixed with a fuel injected from an injector 5, and a resultant air-fuel mixture is drawn into the cylinder 3. An intake valve 6 opens and closes to provide, and shut off, communication between an inside of the cylinder 3 and the intake passage 4. The mixture burned inside the cylinder 3 is exhausted as an exhaust gas to an exhaust passage 7. An exhaust valve 8 opens and closes to provide, and shut off, communication between the inside of the cylinder 3 and the exhaust passage 7.

A throttle valve 9 for regulating the amount of intake air drawn into the cylinder 3 is disposed in the intake passage 4. The throttle valve 9 according to this embodiment is an electronically controlled type and, when the engine 1 runs at idle speed, it is not fully closed and is open to an angle only to supply an amount of air required for running the engine at idle speed (hereinafter referred to as the "idle equivalent opening"). When the engine is started, an open-loop control of the engine speed is executed by keeping the throttle valve 9 open at this idle equivalent opening. A throttle position sensor 10 that detects the opening of the throttle valve 9 is connected to the throttle valve 9.

In addition, the throttle valve 9 is coupled to a throttle motor 11, a driving force of which opens and closes the throttle valve. The throttle motor 11 also serves to function as a clutch for connecting an accelerator pedal to the throttle valve 9 when a fault occurs. An accelerator position sensor 12 that detects an amount of the accelerator pedal operation (accelerator opening) is also disposed near the throttle valve 9. There is also mounted an air flow meter 13 for detecting the amount of intake air on the intake passage 4. The air flow meter 13 has a built-in intake air temperature sensor that detects the temperature of the intake air.

A crank position sensor 14 that detects the position of a crankshaft is installed near the crankshaft of the engine 1. The output from the crank position sensor 14 also provides information on the position of a piston 15 in the cylinder 3 and the actual speed of the engine 1 (actual engine speed) NE. In addition, a knock sensor 16 that detects knocking of the engine 1 and a coolant temperature sensor 17 that detects the temperature of a coolant THW are also mounted on the engine 1.

The ignition plug 2, injector 5, throttle position sensor 10, throttle motor 11, accelerator position sensor 12, air flow meter 13, crank position sensor 14, knock sensor 16, coolant temperature sensor 17, and other sensors are connected to an electronic control unit (ECU) 18 that controls the engine 1 comprehensively. They are controlled by signals sent by the ECU 18 or transmit results of detection to the ECU 18. In addition to these sensors, there are also connected to the ECU 18 a catalyst temperature sensor 20 which measures the temperature of a three-way catalyst 19 disposed on the exhaust passage 7, and a purge control valve 22 that purges fuel vapors in a fuel tank trapped by a charcoal canister 21 into the intake passage 4.

An upstream air-fuel ratio sensor 23 mounted on an upstream side of the three-way catalyst 19 and a downstream air-fuel ratio sensor 24 mounted on a downstream side of the three-way catalyst 19 are also connected to the ECU 18. The upstream air-fuel ratio sensor 23 detects the air-fuel ratio on the upstream side of the three-way catalyst 19 and the downstream air-fuel ratio sensor 24 detects the air-fuel ratio on the downstream side of the three-way catalyst 19. These air-fuel ratio sensors 23, 24 are heated by power supplied from the ECU 18 so that they can be quickly heated to an activation temperature.

An idle speed control provided immediately after the above-mentioned engine 1 has been started will be explained.

The idle speed control according to the present embodiment is performed according to the temperature of the coolant of the engine 1. If the engine 1 has been started from a cold state, it must be warmed up so that the temperature thereof will be increased to a level that keeps it in good operating condition. The coolant temperature THW is, however, lower for a period of time from a time when the cold engine is started to a time when the warm-up cycle is completed than the coolant temperature after the completion of the warm-up cycle. The coolant temperature THW after the completion of the warm-up cycle is generally around 70 to 80° C. If the temperature of atmosphere is around 20° C. (what is called the room temperature), the coolant temperature THW is also around 20° C. immediately after the engine 1 has been started from a cold state. An open-loop control is performed until the coolant temperature THW reaches a predetermined temperature KTHWFB and, when the coolant temperature THW becomes greater than or equal to the predetermined temperature KTHWFB, a feedback control is permitted. In the feedback control, the engine speed is controlled so that it maintains an optimum idle speed. The fact that the coolant temperature THW has become greater than or equal to the predetermined temperature KTHWFB means that the engine temperature has reached a predetermined temperature. The predetermined temperature KTHWFB is a temperature that allows the engine speed to better follow up through the feedback control. It is set to a value that brings the engine in a state controllable through the feedback control.

Figure 2:
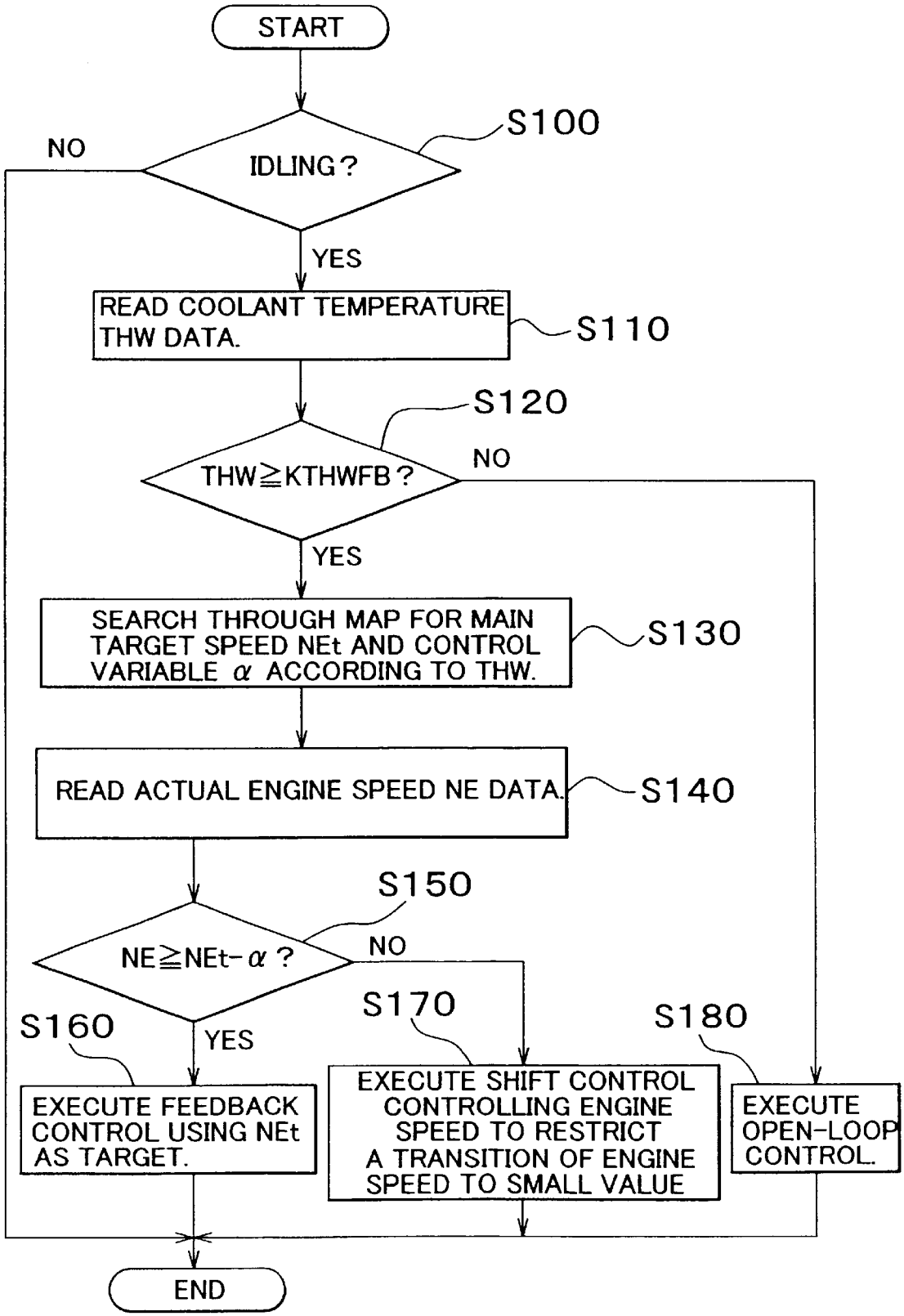
FIG. 2 is a flow chart showing an idle speed control provided by a control system according to the invention.
Figure 3:
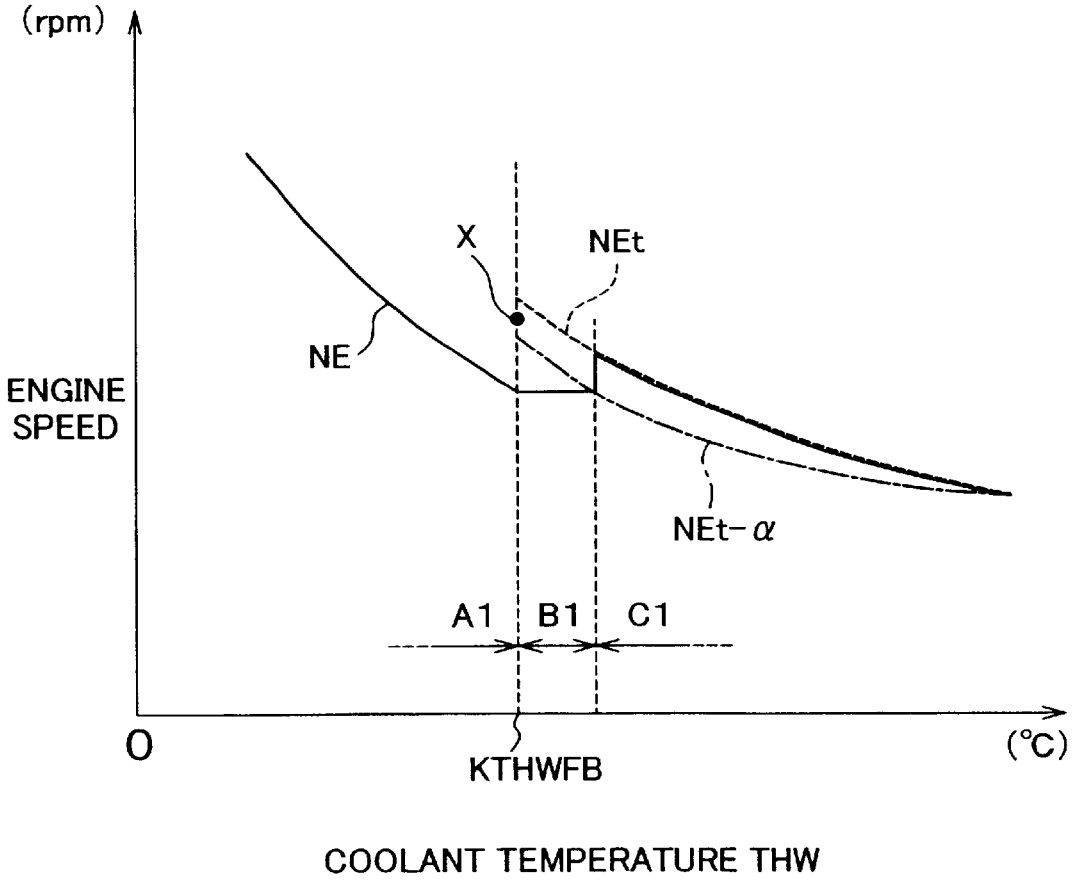
FIG. 3 is a graph showing a relationship between a coolant temperature THW and an engine speed in the control example according to the flow chart shown in FIG. 2.

FIG. 2 shows a flow chart for this control. FIG. 3 shows a relationship between the coolant temperature THW and the engine speed. In FIG. 3, an example of a target engine speed (main target speed) NEt in the feedback control and an actual engine speed NE (where the operation proceeds by way of step 170 in the flow chart shown in FIG. 2) controlled through this control are shown. This control will be explained with reference to FIG. 2 and FIG. 3. The operation of the flow chart shown in FIG. 2 is repeatedly executed at predetermined intervals after an ignition switch has been turned ON.

First of all, it is determined whether the engine 1 is running at idle speed (step 100). Whether the engine is running at idle speed or not is determined based on whether the opening of the throttle valve 9 detected by the throttle position sensor 10 is the idle equivalent opening, and/or based on the amount of accelerator pedal operated as detected by the accelerator position sensor 12. If it is determined that the engine 1 is not running at idle speed, then the idle speed control is not performed and the control shown in FIG. 2 is temporarily terminated.

Since this idle speed control is performed according to the coolant temperature of the engine 1, the coolant temperature THW is first detected by the coolant temperature sensor 17 and the temperature data is read in the ECU 18 if the engine 1 is running at idle speed (step 110). It is then determined by the ECU 18 whether the coolant temperature THW data read in the ECU is greater than or equal to the predetermined temperature KTHWFB (step 120). The predetermined temperature KTHWFB serves as a reference and, as soon as the coolant temperature THW reaches that reference temperature, control is shifted to the feedback control.

If it is determined that the coolant temperature THW is less than the predetermined temperature KTHWFB, namely, if step 120 is negated, it can be considered that the engine 1 is not in a state to be controlled through the feedback control and the open-loop control is performed to control the idle speed of the engine 1 (step 180). If it is determined that the coolant temperature THW is greater than or equal to the predetermined temperature KTHWFB, namely, if step 120 is affirmed, control is executed to proceed to the feedback control. If control is immediately shifted to the feedback control that uses the target speed NEt set according to the coolant temperature THW, however, awkwardness can be felt by the driver as control is executed to bring the actual engine speed NE to the target speed Net, when there is a big difference between the actual engine speed NE and the target speed NEt.

Figure 4:
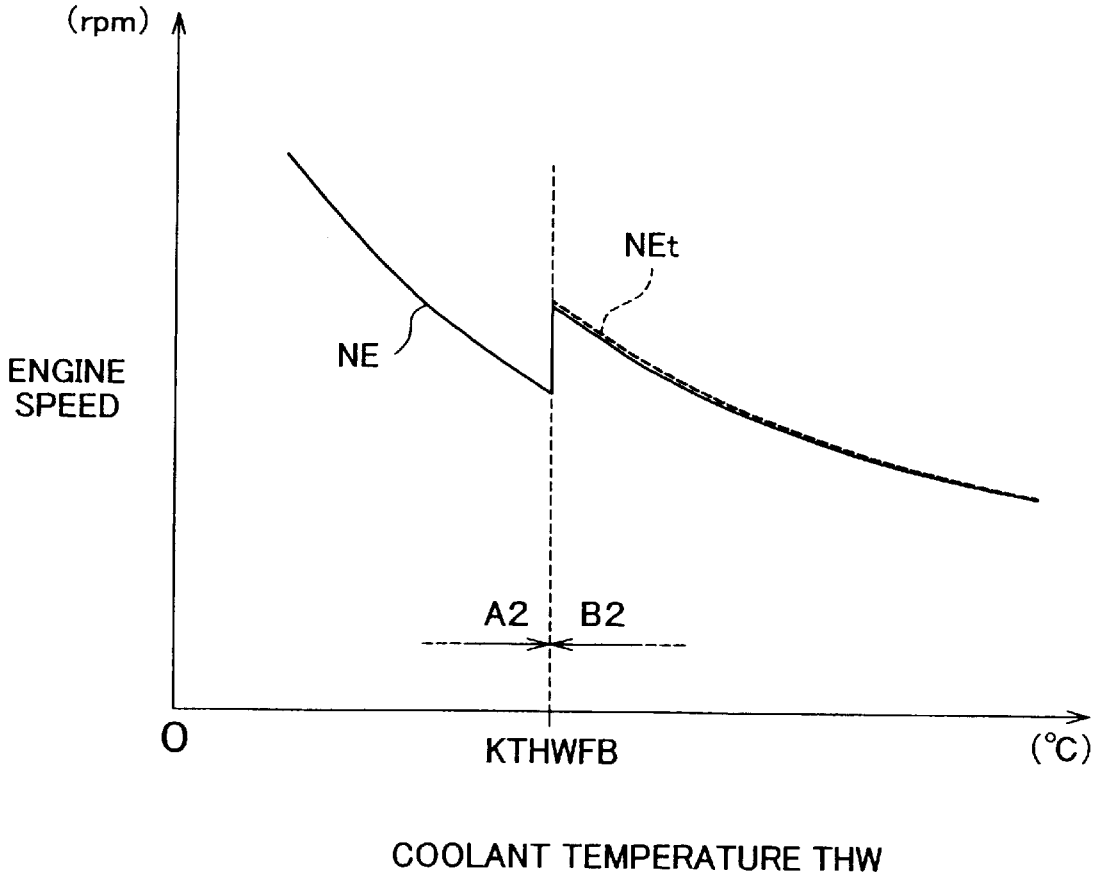
FIG. 4 is a graph showing a relationship between a coolant temperature THW and an engine speed in a typical conventional control.

FIG. 4 shows a relationship between the coolant temperature and the engine speed when control is shifted to the feedback control that uses the target speed NEt with a big difference existing between the actual engine speed NE and the target speed NEt. Referring to FIG. 4, the open-loop control of the idle speed is first provided (section A2), which is followed by the feedback control using the target speed NEt (section B2). In this control, the actual engine speed NE is lower by a large margin than the target speed NEt at a point in time when the coolant temperature THW reaches the predetermined temperature KTHWFB.

Since the feedback control using the target speed NEt is started as soon as the coolant temperature THW reaches the predetermined temperature KTHWFB, however, the speed of the engine 1 is brought to the target speed NEt at one stroke. Such an abrupt increase in the speed of the engine 1 could give the driver a shock and thus an awkward feeling. To prevent this from occurring, in the control according to the present embodiment, the operations detailed hereunder are performed in step 120 and onward.

If step 120 is affirmed, the target speed NEt and a control variable α corresponding to the coolant temperature THW at that point in time are searched through a map stored in the ECU 18 (step 130). As it is known from a NEt curve and a NEt−α curve shown in FIG. 3, the control variable a is a variable for drawing the NEt−α a curve beneath the target speed NEt curve. The magnitude of the variable is a range of increase in the speed that will not cause the driver to feel a shock even when the engine speed is increased at one stroke throughout a given range of coolant temperatures. The control variable a is a linear function, being a positive number that becomes smaller as the coolant temperature THW increases.

The control variable α is not limited to a linear function, but it may be a quadratic or greater function, or any other variable. It may also be set as a constant instead of being a variable as used herein. The output from the crank position sensor 14 is next read in the ECU 18 and the actual engine speed NE of the engine 1 is calculated [the actual engine speed NE is read in] (step 140). It is determined whether the actual engine speed NE obtained through calculation is greater than or equal to NEt−α (step 150).

Since the control variable α is set as described above, if step 150 is affirmative, an amplitude of changes made in the idle speed involved in the shifting of control to the feedback control is so small that it does not give the driver an awkward feeling even if the control is immediately shifted to the feedback control using the target speed NEt. If step 150 is affirmative, therefore, control is shifted to the feedback control using the target speed NEt (step 160). If step 150 is negative, on the other hand, it can be considered that the shift of control mode could give the driver an awkward feeling arising from the amplitude of changes made in the idle speed involved in the shift of control if the control is immediately shifted to the feedback control using the target speed NEt.

In such cases, the actual engine speed NE at that particular point in time is set as the target value (secondary target speed) and control is performed to bring the idle speed of the engine 1 to this secondary target speed. This control of bringing the idle speed of the engine 1 to the secondary target speed may be an open-loop control or a feedback control. Since such a control in which the idle speed of the engine 1 is maintained at a given value does not involve a sudden change of the idle speed, it does not give the driver an awkward feeling.

After step 160, step 170, and step 180, the control of the flow chart shown in FIG. 2 is temporarily terminated. If the control shown in FIG. 2 is terminated by way of step 170, the coolant temperature THW of the engine 1 increases as the control of the flow chart shown in FIG. 2 is repeatedly executed at predetermined intervals. This involves the target speed NEt and NEt−α becoming lower. As a result, the actual engine speed NE of the engine 1 will eventually coincide with NEt−α. When this occurs, the control which has so far proceeded by way of step 170 after step 150 was negative, is shifted to a flow to go through step 160 after step 150 is affirmative. Namely, control is shifted to the feedback control using the target speed NEt.

In this case, the amplitude of changes made in the idle speed of the engine 1 involved in the shift of control to the feedback control using the target speed NEt is smaller than the speed defined by the control variable α, which gives the driver no awkward feeling.

The graph shown in FIG. 3 represents changes over time in the actual engine speed after the engine has been started. The control of the flow chart shown in FIG. 2 by way of step 180 is first executed, then the control by way of step 170 is executed, and finally the control by way of step 180 is executed. The graph shows the actual engine speed NE in each of these control processes.

Referring to the graph shown in FIG. 3, in section A1, in which the coolant temperature THW remains lower than the predetermined temperature KTHWFB, the idle speed of the engine 1 is controlled through the open-loop control. As the idle speed is controlled through the open-loop mode, the coolant temperature THW increases to reach the predetermined temperature KTHWFB and the feedback control using the target speed NEt is then permitted. Since there is a big difference between the actual engine speed NE and the target speed NEt at this point (bigger than the difference in speed defined by the control variable α), however, control is first provided so as to maintain the idle speed at the actual engine speed NE recorded when the coolant temperature THW reaches the predetermined temperature KTHWFB. Section B1 represents this control.

While control is provided to maintain the idle speed in section B1, the coolant temperature continues rising and the actual engine speed coincides with the speed defined by NEt−α. Under these conditions, there is no chance of the driver being given an awkward feeling even when control is shifted to the feedback control using the target speed NEt. Hence, the control shifts to the feedback control using the target speed NEt. Section C1 represents this control. When the feedback control using the target speed NEt is hereafter continued, the engine 1 finishes warming up. After the engine 1 has warmed up, a predetermined value (for example, 600 rpm to 700 rpm) is assigned for the target speed NEt with the control variable α being 0.

In the example shown in FIG. 3, the actual engine speed NE when the coolant temperature THW reaches the predetermined temperature KTHWFB is lower than NEt−α. If, for example, the actual engine speed NE when the coolant temperature THW reaches the predetermined temperature KTHWFB is X in FIG. 3, control is immediately shifted to the feedback control using the target speed NEt.

Figure 5:
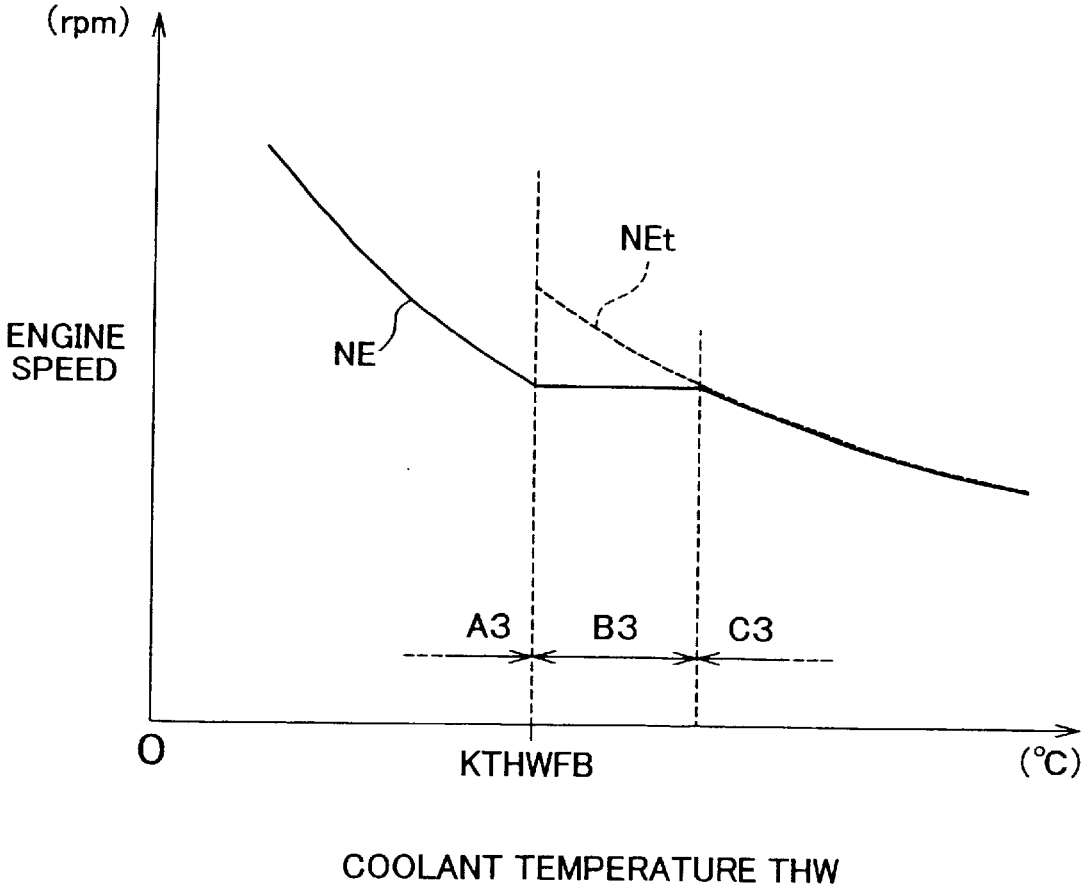
FIG. 5 is a graph showing a relationship between a coolant temperature THW and an engine speed in another control example according to the control system of this invention.

A control system according to another embodiment of the invention will be explained. FIG. 5 shows the relationship between the coolant temperature and the engine speed when control is immediately shifted to the feedback control using the target speed NEt with a big difference existing between the actual engine speed NE and the target speed NEt in this embodiment. In this embodiment, a difference is detected between the actual engine speed NE and the target speed NEt when the coolant temperature THW reaches the predetermined temperature KTHWFB and it is determined whether the difference is more than a predetermined difference in speed β. The speed difference β is a permissible speed difference value that is considered to give no awkward feeling to the driver when the control is switched. If the difference between the actual engine speed NE and the target speed NEt is less than the permissible speed difference β, control is immediately shifted to the feedback control using the target speed NEt. Namely, a determination of whether the actual engine speed NE is greater than or equal to NEt−α in step 150 of the flow chart shown in FIG. 2 is replaced by a determination of whether the difference between the actual engine speed and the target speed NEt is greater than or equal to the permissible speed difference β.

If the difference between the actual engine speed NE and the target speed NEt is greater than or equal to the permissible speed difference β, however, control is first provided to maintain the actual engine speed NE at that particular point in time (section B3). As the control to maintain the actual engine speed NE is continued, the coolant temperature THW increases. This control is continued until the actual engine speed NE coincides with the target speed NEt and, as soon as there is coincidence between the two speeds, control is shifted to the feedback control using the target speed NEt (section C3). Through such processes of control, there is no chance of causing the idle speed control to increase the engine speed, thus further preventing the driver from being given an awkward feeling. The control, in the meantime, introduces a slight delay in shifting to the feedback control using the target speed NEt.

In the control shown in FIG. 3, on the other hand, control is shifted to the feedback control when the actual engine speed NE reaches the speed level of NEt−α, which is the target speed less the control variable α. This means that the control proceeds to the feedback mode using the target speed NEt earlier. The idle speed may be increased in this case when the control proceeds to the feedback mode; however, since the control variable α is set to a small value that will not give the driver an awkward feeling, there is no chance of the driver being given an awkward feeling.

As still another embodiment, it is possible that, if there is a big difference between the actual engine speed NE and the target speed (main target speed) NEt when the coolant temperature THW reaches the predetermined temperature KTHWFB, any given secondary target speed is first set between the actual engine speed NE and the target speed (main target speed) NEt and then the actual engine speed NE is increased to the secondary target speed at one stroke. At this time, the secondary target speed is set so as not to give the driver an awkward feeling even when the actual engine speed NE is increased to this secondary target speed at one stroke. If the secondary target speed is thereafter gradually brought to the main target speed, then the control can be smoothly shifted to the feedback control using the main target speed.

The invention is not limited to these embodiments. Though the idle speed is controlled by regulating the amount of intake air in the foregoing embodiments, another control variable may be used for controlling the idle speed, for example the ignition timing. It is also possible to use the amount of intake air and ignition timing in combination. Furthermore, in the foregoing embodiments the idle speed is controlled according to the coolant temperature THW of the engine 1, but another type of variable data may be used as the basis for controlling the idle speed.

All of the foregoing embodiments were intended to increase the engine speed by a large margin when the actual engine speed NE is far below the target speed NEt. The invention is not, however, limited to such applications and may be applicable to a case in which the amplitude of changes in the engine speed becomes great when the control is shifted from the open-loop mode to the feedback mode. Namely, the invention is also applicable to a case in which the actual engine speed NE is higher than the target speed NEt. It must be noted, however, that the idle speed of the engine 1 during a warm-up cycle generally is on a high side and gradually falls to at a constant level after the warm-up cycle is completed. It can therefore be considered that the driver does not tend to get an awkward feeling when the engine speed falls, but rather he or she tends to have an awkward feeling when the engine speed is increased as the control is shifted.

In the above embodiments, the idle speed is brought to a target level in a step-by-step manner through such processes as those performed in section B1 and section B3. In the case shown in FIG. 3, control is shifted to the feedback control using the target speed NEt after the difference between the actual engine speed NE and the target speed NEt has become less than a predetermined value (the control variable α in the above example). Moreover, in the case shown in FIG. 3, control is performed by using the secondary target speed (the actual engine speed NE when the coolant temperature THW becomes the predetermined temperature KTHWFB in the above example) before it is shifted to the feedback control using the target speed (main target speed) NEt.

According to one embodiment of this invention, the actual engine speed of the internal combustion engine is brought to a target speed of the feedback control in a step-by-step manner and it is possible to damp shock occurring when the open-loop control is shifted to the feedback control.

According to another embodiment of the invention, the difference between the actual engine speed and the target speed of the feedback control is made smaller by maintaining the actual engine speed in the open-loop control for a predetermined period of time before the control is shifted to the feedback control using the target speed. As a result, it is possible to damp shock occurring when the open-loop control is shifted to the feedback control.

According to still another embodiment of the invention, the actual engine speed of the internal combustion engine is temporarily brought to a secondary target speed set between the actual engine speed in the open-loop control and the main target speed in the feedback control and then the control is finally shifted to the feedback control using the main target speed. This makes it possible to damp shock occurring when the open-loop control is shifted to the feedback control.

According to a further embodiment of the invention, when it is attempted to shift the control of the idle speed after the internal combustion engine has been started from the open-loop control to the feedback control according to the coolant temperature when the coolant temperature has become greater than or equal to a predetermined temperature, the idle speed is maintained for a predetermined period of time before shifting to the feedback control using the target speed. The coolant temperature therefore increases to lower the target speed while the idle speed is maintained for the predetermined period of time. As a result, the feedback control using the target speed is started after the difference between the actual engine speed and the target speed becomes small, which makes it possible to damp shock occurring when the open-loop control is shifted to the feedback control.

At this time, the idle speed is maintained for the predetermined period of time only if the difference between the actual engine speed in the open-loop control and the target speed in the feedback control is a predetermined value or more. If the difference between the actual engine speed in the open-loop control and the target speed in the feedback control is less than the predetermined value, control may be shifted to the feedback control using the target speed earlier, without bringing the actual engine speed to the target speed of the feedback control in a step-by-step manner.

What is claimed is:

1. An idle control system of an internal combustion engine, comprising:

a control device adapted to provide an open-loop control for an idle speed of the internal combustion engine after the internal combustion engine has been started from a cold state and, following this open-loop control, to provide a feedback control for controlling the idle speed, wherein the control device is adapted to bring an engine speed to a target speed, which falls as the coolant temperature rises, of the feedback control in a step-by-step manner when shifting from the open-loop control to the feedback control.

2. The control system according to claim 1, wherein:

the control device is adapted to bring the engine speed to the target speed of the feedback control in a step-by-step manner only when a difference between the engine speed and the target speed of the feedback control is a predetermined value or more.

3. The control system according to claim 1, wherein:

the control device is adapted to control the idle speed according to the temperature of D the internal combustion engine and to shift control of the idle peed from the open-loop control to the feedback control when the coolant temperature becomes at least a predetermined temperature.

4. An idle control system of an internal combustion engine, comprising:

a control device adapted to provide an open-loop control for an idle speed of the internal combustion engine after the internal combustion engine has been started from a cold state and, following this open-loop control, to provide a feedback control for controlling the idle speed, wherein the control device is adapted to maintain an engine speed for a predetermined period of time when attempting to shift from the open-loop control to the feedback control, and when the difference between the engine speed and a target speed, which falls as the coolant temperature rises, of the feedback control becomes less than a predetermined value, to shift to the feedback control for bringing the idle speed to the target speed.

5. An idle control system of an internal combustion engine, comprising:

a control device adapted to provide an open-loop control for an idle speed of the internal combustion engine after the internal combustion engine has been started from a cold state and, following this open-loop control, to provide a feedback control for controlling the idle speed, wherein the control device is adapted to set a secondary target speed that falls within a range between an engine speed in the open-loop control and a main target speed, which falls as the coolant temperature rises, of the feedback control when shifting from the open-loop control to the feedback control and, after providing a control to bring the idle speed to the secondary target speed, to shift to the feedback control using the main target speed.

6. An idle control system of an internal combustion engine, comprising:

a control device adapted to provide an open-loop control for an idle speed of the internal combustion engine after the internal combustion engine has been started from a cold state and, following this open-loop control, to provide a feedback control for controlling the idle speed, wherein the control device is adapted to shift the control of the idle speed from the open-loop control to the feedback control when a coolant temperature becomes a predetermined temperature or more and, only when a difference between an engine speed when the coolant temperature of the internal combustion engine becomes the predetermined temperature and a target speed, which falls as the coolant temperature rises, of the feedback control is a predetermined value or more, the control device is adapted to provide a control to maintain the idle speed for a predetermined period of time before shifting to the feedback control using the target speed.

7. An idle control system of an internal combustion engine, comprising:

a control device adapted to provide an open-loop control for an idle speed of the internal combustion engine after the internal combustion engine has been started from a cold state and, following this open-loop control, to provide a feedback control for controlling the idle speed, wherein only when a difference between the engine speed and the target speed, which falls as the coolant temperature rises, of the feedback control is a predetermined value or more when shifting from the open-loop control to the feedback control, the control device is adapted to restrict a transition of an engine speed to a target speed of the feedback control to a value which is smaller than the predetermined value.

8. An idle control method of an internal combustion engine, comprising:

providing an open-loop control for an idle speed of the internal combustion engine after the internal combustion engine has been started from a cold state, attempting to transit from the open-loop control to the feedback control when a coolant temperature of the internal combustion engine becomes a predetermined temperature or more, determining if a difference between the engine speed and the target speed, which falls as the coolant temperature rises, of the feedback control is a predetermined value or more, and transiting the engine speed to the target engine speed of the feedback control in a value which is smaller than the predetermined value when the difference between the engine speed and the target speed of the feedback control is a predetermined value or more.

9. The control method according to claim 8, wherein the transiting step brings an engine speed to a target speed of the feedback control in a step-by-step manner.

10. The control method according to claim 8, wherein the transiting step sets a secondary target speed that falls within a range between an engine speed in the open-loop control and a main target speed of the feedback control, and after providing a control to bring the idle speed to the secondary speed, shifts to the feedback control using the main target speed.

11. The control method according to claim 8, wherein the transiting step shifts the open-loop control to the feedback control using the target engine speed after maintaining an engine speed for a predetermined period of time.

12. An idle control system of an internal combustion engine, comprising:

control means for providing an open-loop control for an idle speed of the internal combustion engine after the internal combustion engine has been started from a cold state and, following this open-loop control, for providing a feedback control for controlling the idle speed, wherein the control means brings an engine speed to a target speed, which falls as the coolant temperature rises, of the feedback control in a step-by-step manner when shifting from the open-loop control to the feedback control.

13. The control system according to claim 12, wherein:

the control means brings the engine speed to the target speed of the feedback control in a step-by-step manner only when a difference between the engine speed and the target speed of the feedback control is a predetermined value or more.

14. An idle control system of an internal combustion engine, comprising:

control means for providing an open-loop control for an idle speed of the internal combustion engine after the internal combustion engine has been started from a cold state and, following this open-loop control, for providing a feedback control for controlling the idle speed, wherein the control means maintains an engine speed for a predetermined period of time when attempting to shift from the open-loop control to the feedback control and, when the difference from a target speed, which falls as the coolant temperature rises, of the feedback control becomes less than a predetermined value, shifts to the feedback control for bringing the idle speed to the target speed.

15. An idle control system of an internal combustion engine, comprising:

control means for providing an open-loop control for an idle speed of the internal combustion engine after the internal combustion engine has been started from a cold state and, following this open-loop control, for providing a feedback control for controlling the idle speed, wherein the control means sets a secondary target speed that falls within a range between an engine speed in the open-loop control and a main target speed, which falls as the coolant temperature rises, of the feedback control when shifting from the open-loop control to the feedback control and, after providing a control to bring the idle speed to the secondary target speed, shifts to the feedback control using the main target speed.

16. An idle control system of an internal combustion engine, comprising:

control means for providing an open-loop control for an idle speed of the internal combustion engine after the internal combustion engine has been started from a cold state and, following this open-loop control, for providing a feedback control for controlling the idle speed, wherein the control means shifts the control of the idle speed from the open-loop control to the feedback control when a coolant temperature becomes a predetermined temperature or more and, only when a difference between an engine speed when the coolant temperature of the internal combustion engine becomes the predetermined temperature and a target speed, which falls as the coolant temperature rises, of the feedback control is a predetermined value or more, provides a control to maintain the idle speed for a predetermined period of time before shifting to the feedback control using the target speed.

17. An idle control system of an internal combustion engine, comprising:

control means for providing an open-loop control for an idle speed of the internal combustion engine after the internal combustion engine has been started from a cold state and, following this open-loop control, provides a feedback control for controlling the idle speed, wherein only when a difference between the engine speed and the target speed, which falls as the coolant temperature rises, of the feedback control is a predetermined value or more when shifting from the open-loop control to the feedback control, the control means restricts a transition of an engine speed to a target speed of the feedback control to a value which is smaller than the predetermined value.

* * * * *